US012433418B2

(12) United States Patent
Srinivasan et al.

(10) Patent No.: US 12,433,418 B2
(45) Date of Patent: Oct. 7, 2025

(54) ROCKING BED THAT PRODUCES PITCH, ROLL, TRANSLATIONAL AND VIBRATION MOVEMENTS

(71) Applicant: Rock to Sleep Bed LLC, San Diego, CA (US)

(72) Inventors: Radhakrishnan Srinivasan, San Diego, CA (US); Preetham K. Shivanna, Mysuru (IN)

(73) Assignee: Rock to Sleep Bed LLC, San Diego, CA (US)

( * ) Notice: Subject to any disclaimer, the term of this patent is extended or adjusted under 35 U.S.C. 154(b) by 269 days.

(21) Appl. No.: 17/817,280

(22) Filed: Aug. 3, 2022

(65) Prior Publication Data

US 2023/0255360 A1 Aug. 17, 2023

Related U.S. Application Data

(60) Provisional application No. 63/360,242, filed on Sep. 20, 2021.

(51) Int. Cl.
*A47C 21/00* (2006.01)
*A47D 9/02* (2006.01)

(52) U.S. Cl.
CPC ..... *A47C 21/006* (2013.01); *A47D 9/057* (2022.08)

(58) Field of Classification Search
CPC ..... A47C 21/006; A47C 3/0251; A47C 3/026; A47D 9/057; A61G 7/005; A61G 13/04; A61B 6/0487
See application file for complete search history.

(56) References Cited

U.S. PATENT DOCUMENTS 525,952 A * 9/1894 Gorham ..... A61G 7/005 5/604
2,295,006 A * 9/1942 Philips ..... A61G 5/006 5/624
2,692,173 A * 10/1954 Lowitzsch ..... A61B 6/0487 5/601

(Continued)

FOREIGN PATENT DOCUMENTS

CN 116531193 A * 8/2023
GB 2307025 A * 5/1997 ..... A47D 13/10

(Continued)

*Primary Examiner* — Eric J Kurilla
(74) *Attorney, Agent, or Firm* — Hassan Abbas Shakir; Shakir Law PLLC

(57) ABSTRACT

A rocking bed is disclosed which produces pitching (movement up and down relative to the sleeper), rolling (side to side relative to the sleeper), or translational (movement within the X-Y plane without changing orientation of the sleeper) motion to trigger sensory mismatch which aids the onset of sleep. One embodiment of the bed comprises a top frame supported by triangular trusses, which can rotate freely through pillow block bearings. A motor and crank shaft mechanism causes the bed to pitch upwards and downwards. Another rocking bed embodiment is disclosed wherein the top frame sits on an inverted pyramid structure, which sits on a ball and socket joint that is fixed to the base frame with two motors. These motors permit the full range of motion and can combine types of motion to accelerate sleep onset.

2 Claims, 2 Drawing Sheets

(56) References Cited

U.S. PATENT DOCUMENTS 2,816,806 A * 12/1957 Zaalberg ..... A61B 6/0487 5/601
3,462,772 A * 8/1969 Morrison ..... A61G 7/005 5/613
3,638,247 A * 2/1972 Kennedy ..... A61G 7/005 5/100
3,797,050 A * 3/1974 Benoit ..... A61G 7/005 5/610
5,275,175 A * 1/1994 Poirier ..... A61G 13/04 128/845
6,155,976 A * 12/2000 Sackner ..... A61H 31/008 600/300
2007/0107122 A1* 5/2007 Georgi ..... A61G 13/04 5/11
2009/0300844 A1* 12/2009 Taylor ..... A61G 13/06 5/607
2012/0036635 A1* 2/2012 Lapointe ..... A47D 9/057 5/105
2012/0198624 A1* 8/2012 Zheng ..... A61B 6/0487 5/601
2015/0289677 A1* 10/2015 Huntsberger ..... A47D 1/10 297/344.21
2018/0116885 A1* 5/2018 St. John ..... A61G 7/005

FOREIGN PATENT DOCUMENTS

JP S6323634 * 2/1988
JP S6323634 U * 2/1988
JP 2010124856 A * 6/2010 ..... A47C 3/0251
KR 910002184 Y1 * 4/1991
KR 20150003497 A * 1/2015
WO WO-2009096718 A2 * 8/2009 ..... A47C 19/045
WO WO-2021119527 A1 * 6/2021 ..... A47C 1/0242

* cited by examiner

ROCKING BED THAT PRODUCES PITCH, ROLL, TRANSLATIONAL AND VIBRATION MOVEMENTS

REFERENCES

This application claims benefit of the provisional application 63/360,242, with a filing date of Sep. 20, 2022.

Reason, J. T. 1970. Motion sickness: a special case of sensory rearrangement.
Advancement of Science 26: 386-393.

All references described herein are incorporated by reference in their entirety.

BACKGROUND OF THE INVENTION

The inability or the difficulty in getting to sleep is a problem for many people, and this contributes to a lack of sleep as well as shorter duration of sleep. This in turn harms physical and mental health. It is the experience of all cultures that rocking infants and young children, either by moving them while holding them or by moving a cradle or rocking bed, can assist in the process of getting them to sleep. Rocking motion is considered to quicken sleep onset because of causing a sensory mismatch or confusion between vestibular information and other streams of sensory information (Reason, 1970). The vestibular system includes the parts of the inner ear and brain that process the sensory information involved with controlling balance and eye movements.

The motion of a rocking bed can be broken down into three categories. First, "pitching" motion, characterized by up and down motion of the bedframe and mattress up and down about its transverse (along the left and right side of the sleeping person, also referred to as the Y axis) axis. "Rolling" motion is a tilting rotation about a longitudinal (from the head to the toe of the sleeping person, often referred to as the X axis) axis. This is distinguished from a turning rotation about the vertical or "Z" axis, within the X-Y plane, referred to sometimes as "yaw" motion. "Translational" motion is a shifting or turning motion, including yawing motion, within the X-Y plane, such as moving a bed side to side without changing its orientation.

Translational motion along a singular plane is often less effective in inducing sleep, particularly in adults. Similarly, a rolling motion, along the sides of the lying person, does always not capture the same effect as a cradle or rocking bed. Different sleepers have different requirements to trigger sensory mismatch.

Most rocking beds do not capture the full range of motion required to create sensory mismatch, and those that do provide a wide range of motion exist require extensive mechanical support via an exterior frame. This includes, for example, anchorage to a ceiling apparatus. A trade-off in the prior art emerges, in which the spatial requirements of permitting a full range of motion limit the practical utility of a bed which permits sensory mismatch. Hammocks, beds built upon a semi-circle, and other non-motorized beds also lack the crucial continuity of motion and run into spatial and mounting issues.

This invention resolves these issues by disclosing a substantially more compact, modular motion system which permits motorized pitching, rolling, and translation motion along either one or more pivot axes or upon a ball socket. Further, this invention discloses a ball and socket mechanism which provides an unexpectedly high range of motion despite the mechanical stress upon the joint.

BRIEF SUMMARY OF THE INVENTION

In this invention, we disclose a motorized rocking bed capable of combinations of motion which represents the full range of motion, which does not require mounting or large support frames, which by inducing sensory mismatch accelerates the onset of sleep.

As discussed, "pitching motion," is rotation about the Y axis, "rolling motion" is rotation about the X axis, and "translational motion" is motion within the X-Y plane which does not change the orientation of the bed.

We disclose a motorized bed capable of the following combinations of motion:

- Pitch, with or without translational motion,
- Roll, with or without translational motion, and
- Pitch combined with roll, with or without translational motion.

FIG. 1. shows an embodiment comprising a rocking bed having a pitching motion, with a top frame structure that is connected using triangular structures (trusses) to an axle, which can rotate freely through pillow block bearings that rest on the base frame. The ends of the axle are connected to two pillow block bearings that are fixed onto the long sides of the rectangular base frame. A motor is connected to the top frame of the bed, using a crank and shaft mechanism that converts rotary motion into linear motion. The crank shaft mechanism causes the bed to move upwards and downwards along the head-to-toe direction. The crank shaft mechanism causes the bed to move upwards and downwards along the sides of the person laying on the bed. This further can be permitted to engaged in translational motion by adding wheels to the bottom frame structure, permitting a limited amount of drift when paired with guards or wheel brakes to halt motion.

FIG. 2 shows an embodiment comprising a rocking bed capable of all three types of motion, wherein the top frame sits on an inverted pyramid structure and the tip of the pyramid structure sits on a ball and socket joint that is fixed to the base frame. There are at least two motors each connected to two adjacent corners on the top frame of the bed using crank shaft mechanisms. Pitching and rolling motion can be created by engaging one or both motors synchronously and asynchronously. This further can be permitted to engaged in translational motion by adding wheels to the bottom frame structure, permitting a limited amount of drift when paired with guards or wheel brakes to halt motion.

DETAILED DESCRIPTION OF THE INVENTION

Figure 1:
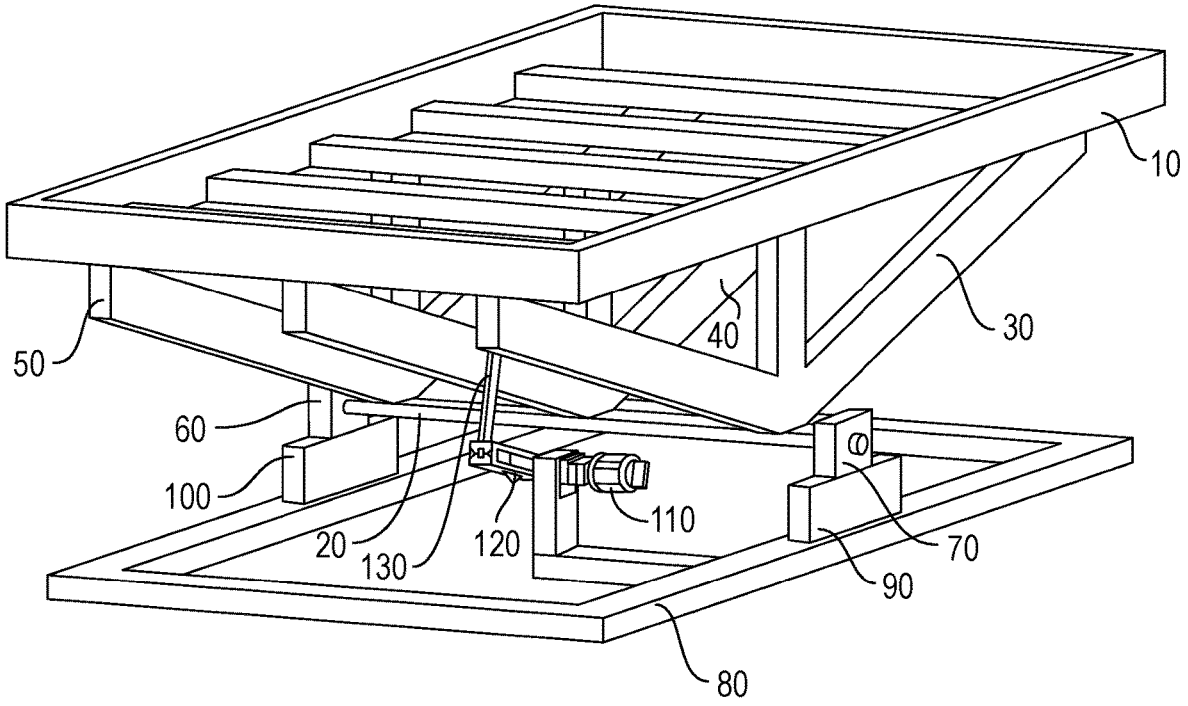
FIG. 1 is a perspective view of a rocking bed with a triangle truss support structure that corresponds to the first embodiment.

FIG. 1 shows a rocking bed that produces pitch motion without-translational motion, wherein the top frame structure of the bed (which holds the mattress) 10 sits on an axle

20 using three arrow shaped structures (trusses), 30, 40 and 50, which are parallel to each other and clamped onto the axle. The ends of the axle 20 are connected to two pillow block bearings, 60 and 70, which are fixed onto the long sides of the rectangular base frame 80 using blocks 90 and 100. The bed produces a pitch motion as the motor 110 is connected to the top frame using a crank 120 and shaft 130. The crank shaft mechanism converts rotary motion into linear motion. The crank shaft mechanism causes the bed to pitch up and down.

An alternative embodiment of the triangular truss type rocking bed comprises a rocking bed capable of rolling motion. For roll motion without translational motion, the device of FIG. 1 would be modified such that the ends of the axle are connected to two pillow block bearings that are fixed onto the short sides (that is, to the left or right side of the sleeping person) of the rectangular base frame. Electronic or mechanical controls may be used for the user to control extent of movement or angle of swing, time duration of rocking, time duration of staying in rest position, switching on or off of motion, resting position/angle of bed and speed of rocking. A method of detecting user's sleep status using sensors or other means, can be used to control the bed's movements and operational duration. This embodiment could be further modified with a secondary axle and motor, permitting a combination of rolling and pitching motion.

Figure 2:
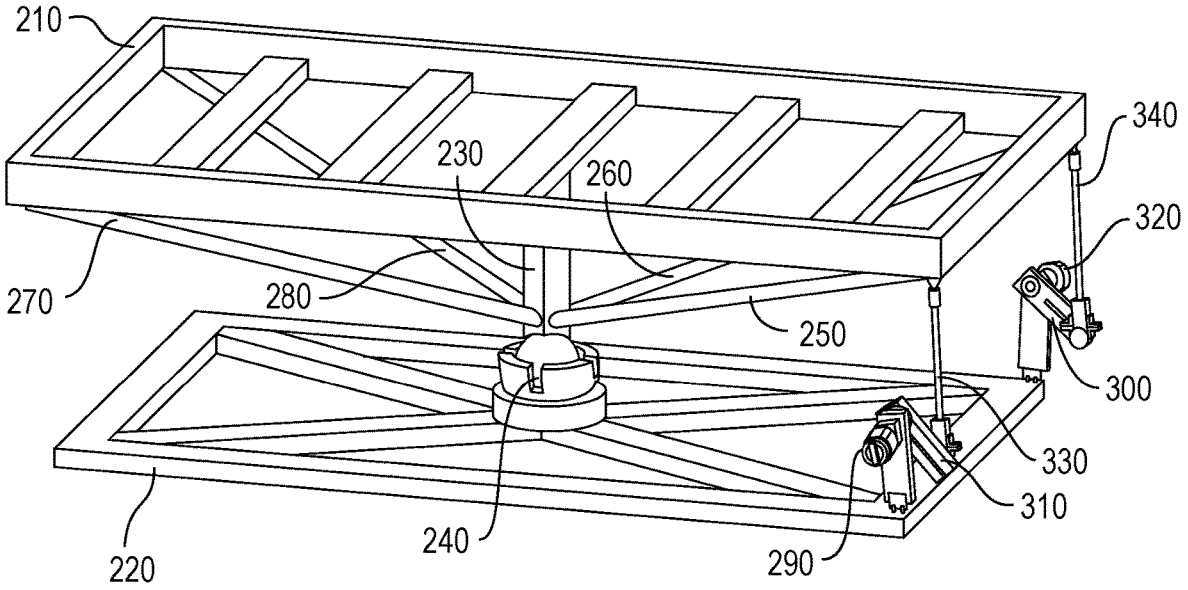
FIG. 2 is a perspective view of a rocking bed with a pyramidal support structure and a ball and socket joint, which corresponds to the second embodiment.

FIG. 2 shows a combined motion rocking bed. The beam 230 connects the top frame (which holds the mattress) 210 to the ball portion of the ball and socket joint 240, which is fixed to the base frame 220. The four corners of the top frame 210 are connected to the base of beam 230 using four pipes 250, 260, 270 and 280. A motor 290 is connected to one corner of the top frame 210 using a crank 310 and shaft 330. Another motor 300 is connected to the top frame 210 in a corner adjacent to the corner where motor 290 is connected, using crank 320 and shaft 340. Different types of motions, pitch and roll, can be created by appropriately operating the two motors as required to generate the motions. For pitch motion, the motors 290 and 300 would be operated such that their respective shafts 330 and 340 move simultaneously upwards or simultaneously downwards. For roll motion, the motors 290 and 300 would be operated such that their respective shafts 330 and 340 move in opposite directions to each other (for example, when shaft 330 is moved upwards, shaft 340 would be moved correspondingly downwards). The user shall have the option to alternate between pitch and roll movements at user defined intervals or in random, if desired. Electronic or mechanical controls may be used for the user to control extent of movement or angle of swing, time duration of rocking, time duration of staying in rest position, activating or deactivating motion, resting position/angle of bed and speed of rocking. A method of detecting user's sleep status using sensors or other means, can be used to control the bed's movements and operational duration. This embodiment is the best mode known to the inventors.

An eccentric rotating mass vibration motor (ECRM) motor may be attached to the frame for producing vibrations at an optimal frequency so as to induce or enhance sleep, in addition to other movements or by itself. An ECRM motor is a direct current (DC) motor with an offset attached to the mass, resulting in net centrifugal force. This can be attached to the top or bottom frame structure. This induces sleep onset by converting rotary motion to linear motion which interacts with the vestibular system to create sensory mismatch. One embodiment for this would entail the device as shown and described in FIG. 2 and above, but wherein the ECRM is connected anywhere along the top frame.

Mechanisms other than motors may be used to create motion (and induce sensory mismatch). One embodiment, beginning with the device as shown and described in FIG. 2 and paragraph 3 of the detailed description, is modified by having the top frame of the bed sit directly on top of an axle, and the axle connects to bearings that are on top of an elevated structure instead of being close to the base frame. Translational motion is created by introducing wheels under the elevated structure and leaving space for the frame structure to move forward-backwards or side-to-side along the X-Y axis. These wheels may be on a track or otherwise limited in their range of motion to avoid creating a risk of the bed drifting or creating safety hazards.

Another embodiment which displays non-motorized means of motion comprises the device above but utilizing springs at the ends of the frame structure. These springs may permit translational motion or vibration, like the ECRM motors discussed above, which may further trigger sensory mismatch in some sleepers. Beginning with the device as shown in FIG. 1 and paragraph 3 of the detailed description, a mechanism such as a brake, dampeners, or a spring set to operate within certain parameters limiting its range of motion (such as designated spring constant) may halt or limit the extent of the translational motion and/or vibration. Electronic or mechanical controls may be used for the user to control intensity of vibration, time duration of vibration, intervals or patterns of vibration, combinations of vibration and motion, and the electronic control of rolling and pitching discussed prior. A method of detecting user's sleep status using sensors or other means, can be used to control the bed's movements and operational duration to optimize sleep onset.

The embodiments discussed and depicted are only illustrative of embodiments of the invention and not limited to such.

The invention claimed is:

1. A rocking bed comprising:

a top frame structure capable of holding a mattress, the top frame structure connecting to a first support structure resting on a pitch axle pivoting between two pillow blocks bearings, a bottom frame structure housing a motor and connecting to a crank and a shaft, wherein the crank and shaft initiates linear motion when the motor is engaged, pitching the top frame structure up and down, and wherein the first support structure is a triangular truss apparatus resting on the pitch axle.

2. The rocking bed of claim 1, wherein the motor is a linear actuator capable of converting rotary motion to linear motion to pitch said top frame structure up and down.

* * * * *